United States Patent [19]

Tsamas

[11] Patent Number: 4,593,440

[45] Date of Patent: Jun. 10, 1986

[54] CLASP WITH POSITIVE LATCH MECHANISM

[75] Inventor: Anton Tsamas, Hackensack, N.J.

[73] Assignee: True-Lok Inc., Lodi, N.J.

[21] Appl. No.: 774,978

[22] Filed: Sep. 11, 1985

Related U.S. Application Data

[63] Continuation-in-part of Ser. No. 633,336, Jul. 23, 1984, and a continuation-in-part of Ser. No. 670,047, Nov. 13, 1984.

[51] Int. Cl.[4] ..... A44B 11/00

[52] U.S. Cl. ..... 24/265 WS; 24/591; 24/308

[58] Field of Search ..... 24/265 WS, 591, 595, 24/597, 598, 594, 585, 590, 180, 307, 308, 309, 310, 616, 116 A, 173

[56] References Cited

U.S. PATENT DOCUMENTS

| | | | |
|---|---|---|---|
| 1,191,279 | 7/1916 | Clark | 24/180 |
| 3,404,440 | 10/1968 | Weiss | 24/265 WS |
| 3,417,578 | 12/1968 | Anderson | 24/265 WS |
| 3,478,537 | 11/1969 | Golberine et al. | 24/265 WS |
| 3,665,565 | 5/1972 | Kruger | 24/265 WS |
| 3,992,757 | 11/1976 | Danna | 24/598 |
| 4,188,688 | 2/1980 | D'Orgelys | 24/591 |

FOREIGN PATENT DOCUMENTS

| | | | |
|---|---|---|---|
| 1095455 | 12/1967 | United Kingdom | 24/598 |

*Primary Examiner*—Victor N. Sakran
*Attorney, Agent, or Firm*—Samuelson & Jacob

[57] ABSTRACT

A clasp includes first and second clasp members which are coupled and uncoupled by complementary pairs of latch members, one of which pairs of latch members is mounted for pivotal movement in response to engagement with the other pair of latch members upon coupling of the clasp members and in response to the selective rotation of an operator for disengagement of the complementary latch members upon uncoupling of the clasp members.

20 Claims, 25 Drawing Figures

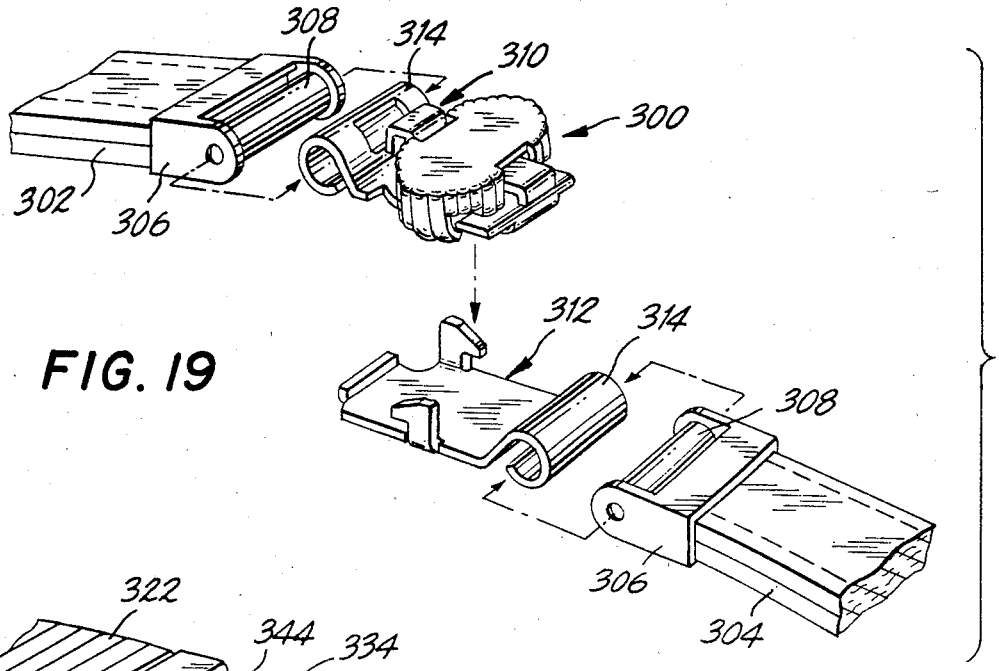
FIG. 19
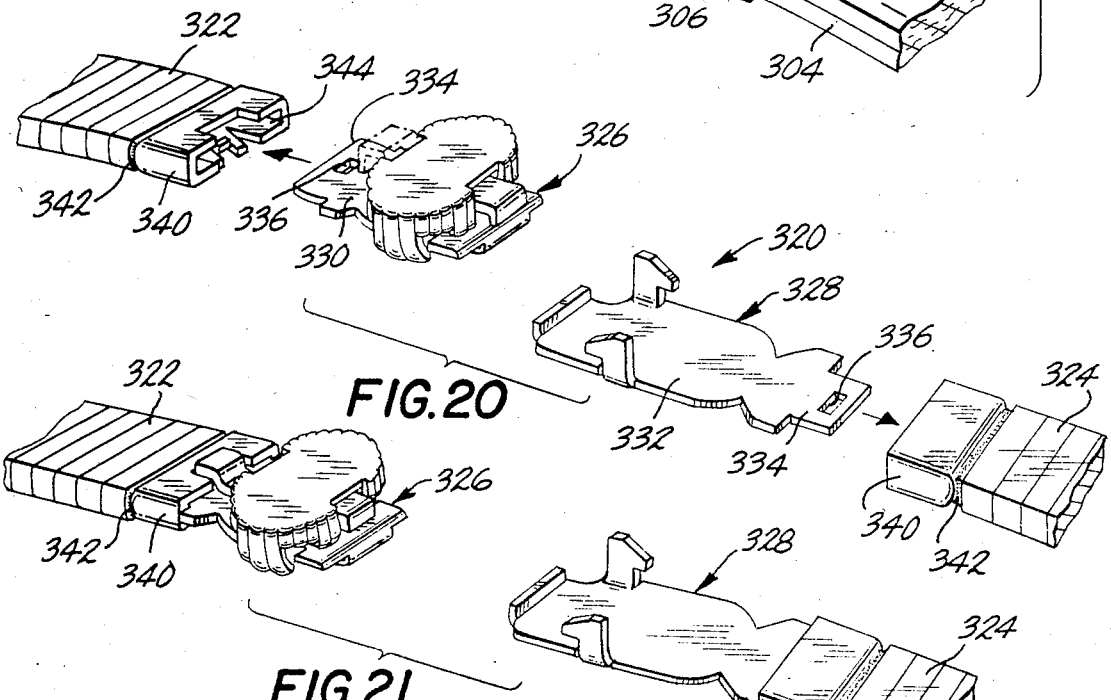
FIG.20
FIG.21
FIG.22
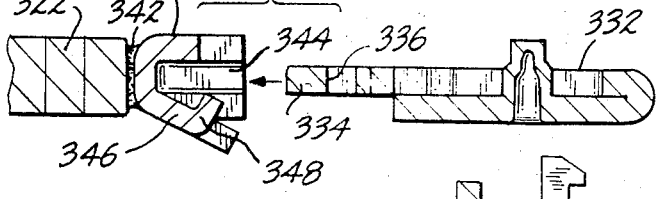
FIG.24
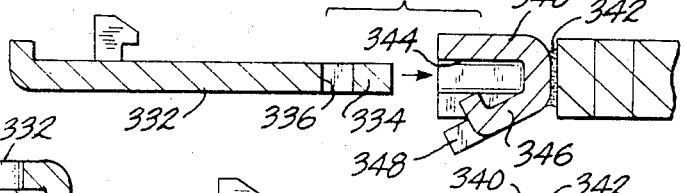
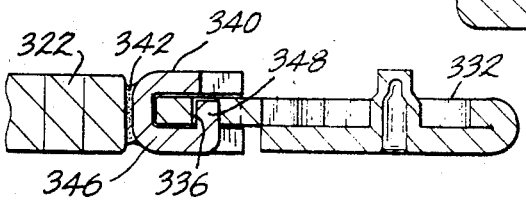
FIG. 23
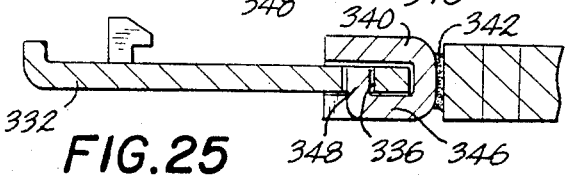
FIG.25

CLASP WITH POSITIVE LATCH MECHANISM

This application is a continuation-in-part of application Ser. No. 633,336, filed July 23, 1984, and application Ser. No. 670,047, filed Nov. 13, 1984.

The present invention relates generally to clasps for ornamental items, such as watch bands, bracelets, necklaces and like articles, and pertains, more specifically, to a clasp having a positive latch mechanism placed within the confines of a compact arrangement for increased security in securing such items upon a wearer.

Clasps for ornamental items to be worn on the person have been the subject of much development throughout the very many years over which people have decorated themselves with bracelets, necklaces and like articles. The search for a clasp which at once is easy to open and close selectively, yet will not open inadvertently, has led to a wide variety of clasp arrangements, providing various advantages and disadvantages. Thus, while some clasps are quite secure when closed properly, they are not easily manipulated into the proper closed configuration, or readily opened intentionally. Others which are handled readily with one hand, as bracelet and watch band clasps must be, do not provide a high degree of security when closed. In addition, clasps for ornamental items should not detract from the aesthetic nature of the article in connection with which the clasps are utilized, a requirement which often calls for a compact, unobtrusive device, without unsightly appendages, and capable of being constructed of precious or semi-precious materials, with economy.

It is an object of the invention to provide a clasp which includes a positive and secure attachment between clasp members, yet is manipulated readily with one hand for ease of attachment and detachment in connection with a variety of ornamental items.

Another object of the invention is to provide a clasp which incorporates a positive latch arrangement for a secure connection, and strongly resists inadvertent detachment, yet is compact and economically manufactured of a variety of materials, including precious and semi-precious metals.

Still another object of the invention is to provide a clasp which is aesthetically pleasing and capable of use with a wide variety of ornamental items without detracting from the appearance of the items.

Yet another object of the invention is to provide a clasp which is simple in operation, unobtrusive in use and adaptable for use with articles worn by both men and women.

A further object of the invention is to provide a clasp which is compact in appearance, yet rugged enough in construction to withstand hard use over an extended service life.

A still further object of the invention is to provide a clasp which is economical to manufacture in large quantities of uniform high quality.

The above objects, as well as still further objects and advantages, are attained by the present invention which may be described briefly as a clasp for connecting together juxtaposed, longitudinally-extending first and second band segments to secure selectively an ornamental item, such as a watch band, upon a wearer, the clasp comprising: a first clasp member; first attaching means for attaching the first clasp member to the first band segment; the first clasp member including a first platform portion extending in directions generally parallel to the longitudinal extent of the first band segment, and at least one pair of first latchimg members carried by the first platform portion and extending generally perpendicular to the first platform portion; a second clasp member; a second attaching means for attaching the second clasp member to the second band segment; the second clasp member including a second platform portion extending in directions generally parallel to the longitudinal extent of the second band segment, and at least one pair of second latching members carried by the second platform portion and extending generally perpendicular to the second platform portion; pivot means mounting at least one of the pairs of first and second latching members for rotation relative to the other of said pairs of first and second latching members upon juxtaposition of the band segments and overlapping of the first and second clasp members, such that the latching members couple together the first and second clasp members in response to overlapping the first and second clasp members; and operator means carried by one of the first and second clasp members and coupled with at least one of the pairs of first and second latching members for movement of that pair of latching members in response to selective manual movement of the operator means such that the latching members are disengaged to uncouple the overlapped first and second clasp members, so as to disconnect selectively the juxtaposed first and second band segments and release the ornamental item from the wearer.

The invention will be understood more fully, while still further objects and advantages will become apparent, in the following detailed description of preferred embodiments thereof illustrated in the accompanying drawing, in which:

FIG. 19 is an exploded perspective view of still another clasp constructed in accordance with the invention;

FIG. 20 is an exploded perspective view of yet another clasp constructed in accordance with the invention;

FIG. 21 is a perspective view of the clasp of FIG. 20;

FIGS. 22 and 23 are longitudinal cross-sectional views illustrating the connection of one clasp member of the clasp of FIG. 20 to a band segment; and FIGS. 24 and 25 are longitudinal cross-sectional views illustrating the connection of the other clasp member of the clasp of FIG. 20 to the other band segment.

Figure 1:
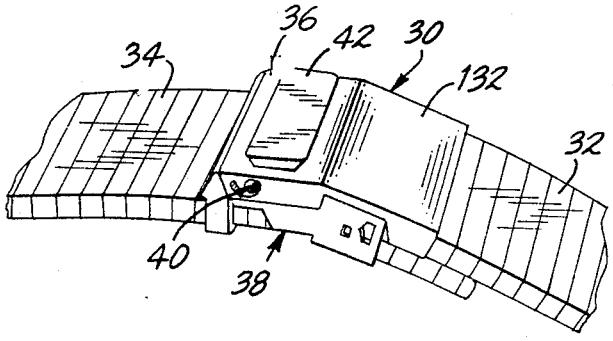
FIG. 1 is a pictorial view of a clasp constructed in accordance with the invention, coupled to secure together watch band segments.

Referring now to the drawing, and especially to FIG. 1 thereof, a clasp 30, constructed in accordance with the invention, is shown connecting together juxtaposed band segments 32 and 34, the end fragments of which are illustrated in the drawing. In this instance, band segments 32 and 34 make up a watch band which is affixed to a men's watch (not shown). Clasp 30 includes a first clasp member shown in the form of a case 36, attached to band segment 32, and a second clasp member shown in the form of a base 38, attached to band segment 34. The clasp members are coupled together to connect the band segments 32 and 34.

Figure 2:
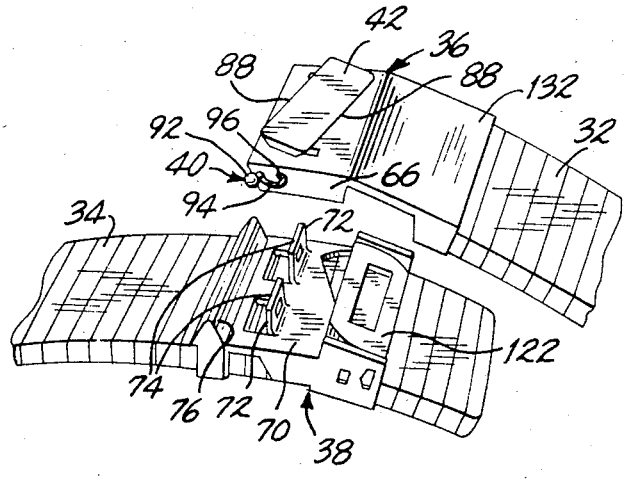
FIG. 2 is a pictorial view of the clasp, uncoupled.

In order to uncouple the case 36 from the base 38, and disconnect the band segments 32 and 34, a locking lever 40 is moved from the position shown in FIG. 1 to the position shown in FIG. 2, and an operator means in the form of a knob 42 is rotated, as shown in FIG. 2, to effect uncoupling. Coupling is achieved merely by overlapping the case 36 with the base 38 and pressing the two clasp members together until an internal latching mechanism 44 secures the clasp members together, as shown in FIG. 3, and will be described in greater detail below.

Figure 3:
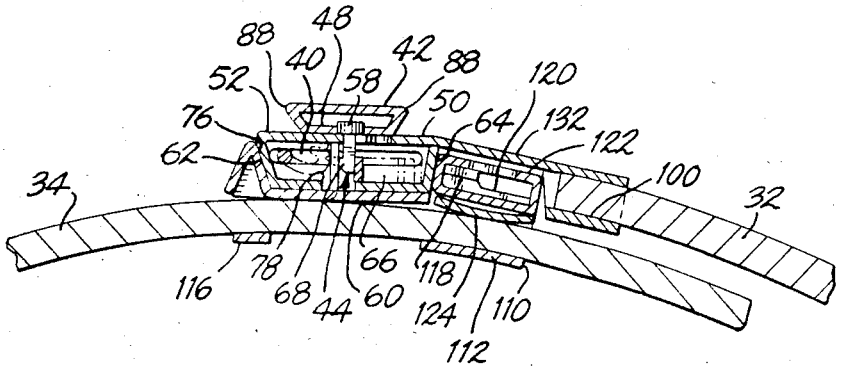
FIG. 3 is a longitudinal cross-sectional view of the clasp, coupled and securing together the watch band segments, the component parts being enlarged and exaggerated in height for illustrative purposes.
Figure 4:
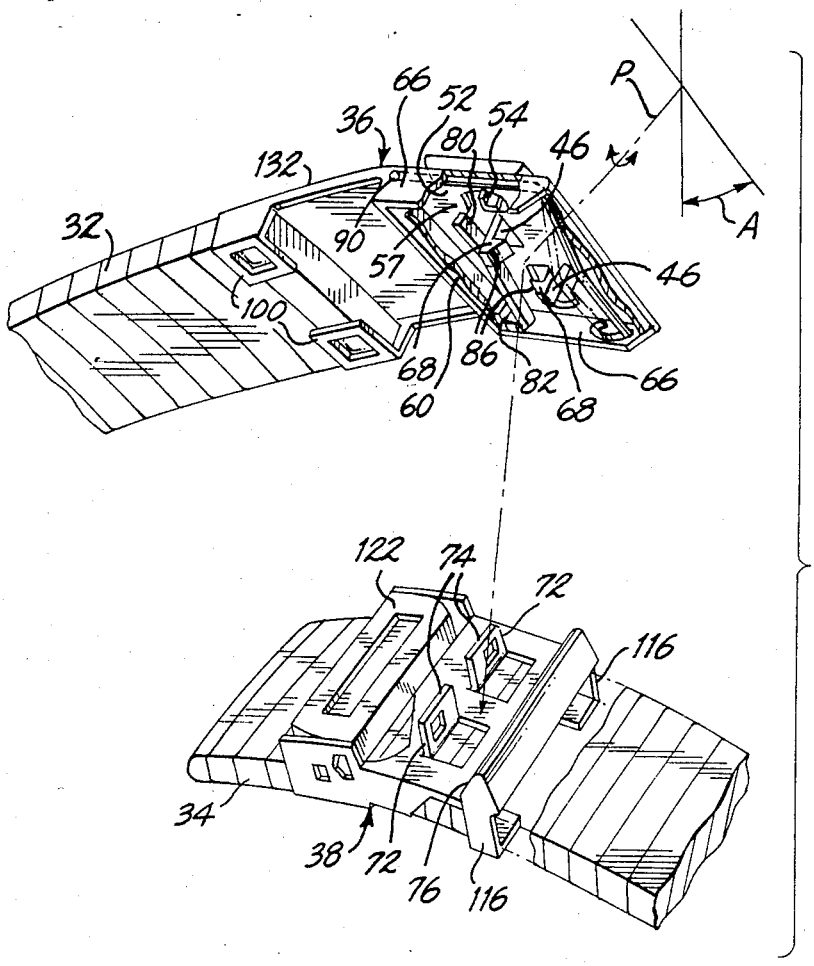
FIG. 4 is a pictorial view of the clasp, uncoupled, as viewed from another position.
Figure 5:
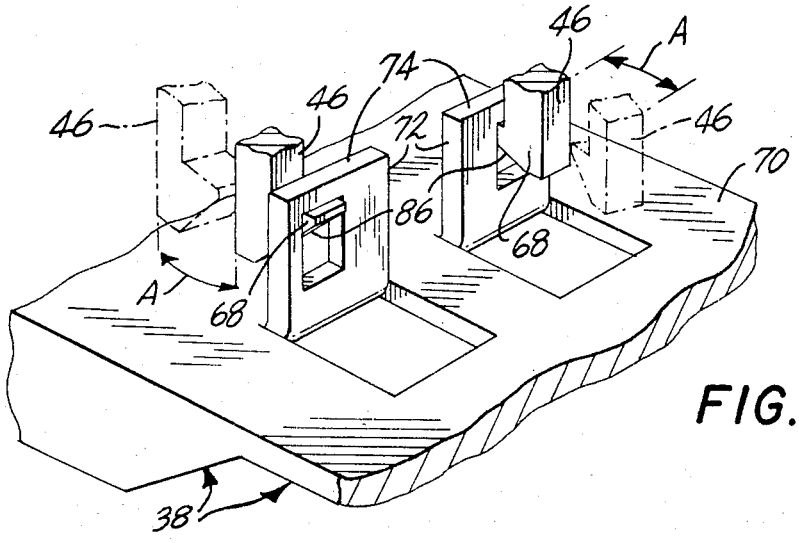
FIG. 5 is a fragmentary perspective view illustrating the latching mechanism of the clasp.
Figure 6:
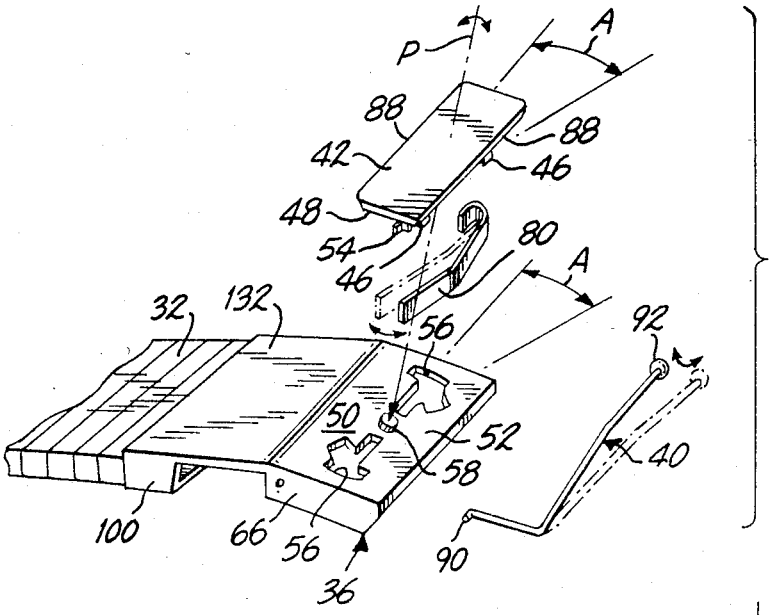
FIG. 6 is an exploded perspective view of one clasp member of the clasp.

As best seen in FIGS. 4, 5 and 6, as well as in FIGS. 1, 2 and 3, latching mechanism 44 includes a pair of first latch members 46 integral with a carriage 48 which engages the upper surface 50 of platform portion 52 of case 36 and is secured against the upper surface 50 by tabs 54 extending downwardly from carriage 48 and passing through slots 56 in platform portion 52. The distal ends of tabs 54 are twisted beneath the lower surface 57 of platform portion 52 to capture carriage 48 upon platform portion 52. A pivot post 58 projects upwardly from the upper surface 50 of platform portion 52 and is journaled within carriage 48 to mount carriage 48 for pivotal movement about a pivotal axis P which extends generally normal to platform portion 52. Slots 56 are elongate in an arcuate configuration and permit rotation of carriage 48 about axis P through an angle of rotation A, preferably of about 20°. Case 36 includes a bottom wall 60, as well as a front wall 62, a rear wall 64 and side walls 66. First latch members 46 are spaced apart laterally, project altitudinally downwardly into case 36 and provide latch teeth 68 spaced downwardly from platform portion 52.

Base 38 also has a platform portion 70. A pair of second latch members 72 project altitudinally upwardly from platform portion 70, are spaced apart laterally to correspond to the lateral spacing between first latch members 46 and provide latch bars 74 spaced upwardly from platform portion 70. A rear guide wall 76 extends upwardly along the rearward edge of platform portion 70. Upon juxtaposition of the band segments 32 and 34, case 36 is overlapped with base 38 and the case 36 is moved into engagement with the base 38 in a direction normal to the platform portions 52 and 70, that is, in a direction parallel to pivotal axis P. Proper alignment is facilitated by the engagement of front wall 62 of case 36 with rear guide wall 76 of base 38 and second latch members 72 enter corresponding apertures 78 in bottom wall 60 of case 36.

Normally, latch teeth 68 are biased into a latching position, illustrated in full lines in FIGS. 3, 4 and 5, by biasing means shown in the form of a leaf spring 80 secured at 82 to a side wall 66, within case 36, and extending laterally to engage one of the first latch members 46 and urge the carriage 48 and the first latch members 46 into the latching position. As the case 36 is seated upon the base 38, camming means in the form of inclined surfaces 86 on latch teeth 68 engage corresponding latch bars 74 and displace the latch teeth 68 away from the latching position, against the bias of leaf spring 80, in response to movement of the case 36 into seated engagement with base 38, by virtue of rotation of carriage 48 about pivotal axis P. As soon as the latch teeth 68 clear the latch bars 74, leaf spring 80 will urge the latch teeth back to the latching position, where the latch teeth 68 extend beneath the latch bars 74, and the case 36 is coupled positively to the base 38, connecting together the band segments 32 and 34.

When it is desired to disconnect the band segments 32 and 34, the case 36 is uncoupled from the base 38 simply by manually turning knob 42, as seen in FIG. 2, to move the latch teeth 68 to a disengaged position, as illustrated in phantom in FIG. 5, where the latch teeth 68 are disengaged from the latch bars 74 to release case 36 from base 38. Knob 42 is raised above the upper surface 50 of platform portion 52 to provide finger grips 88 which facilitate grasping of the knob 42 for pivotal movement about axis P to release the latching mechanism 44.

In order to preclude inadvertent release of the latching mechanism 44, locking lever 40 is moved into the locking position shown in FIG. 1. Locking lever 40 is anchored within case 36 at end 90 of the locking lever 40. The opposite end 92 of locking lever 40 projects through a guide slot 94 in a side wall 66 of case 36. The resilience of locking lever 40 tends to maintain the locking lever 40 in the unlocked position, as shown in FIGS. 2 and 4; however, manual placement of the end 92 within a hooked portion 96 of guide slot 94 moves the locking lever 40 into engagement with one of the first latch members 46, as shown in phantom in FIG. 4, to preclude all rotation of carriage 48 and concomitant disengagement of the latch teeth 68 from the latch bars 74. Movement of the end 92 of locking lever 40 to the position shown in FIG. 2 enables rotation of knob 42, and carriage 48, to release the latching mechanism 44.

As best seen in FIG. 4, the first clasp member is attached to band segment 32 by attaching means shown in the form of brackets 100 integral with case 36 and affixed to the terminal end of the band segment 32. In the illustrated embodiment, band segment 32 is constructed of metal and brackets 100 are secured by soldering. It is desirable to provide for selective adjustment of the position of at least one of the clasp members along the band segments, particularly in watch bands, to accommodate the various sizes required by different wearers.

Figure 7:
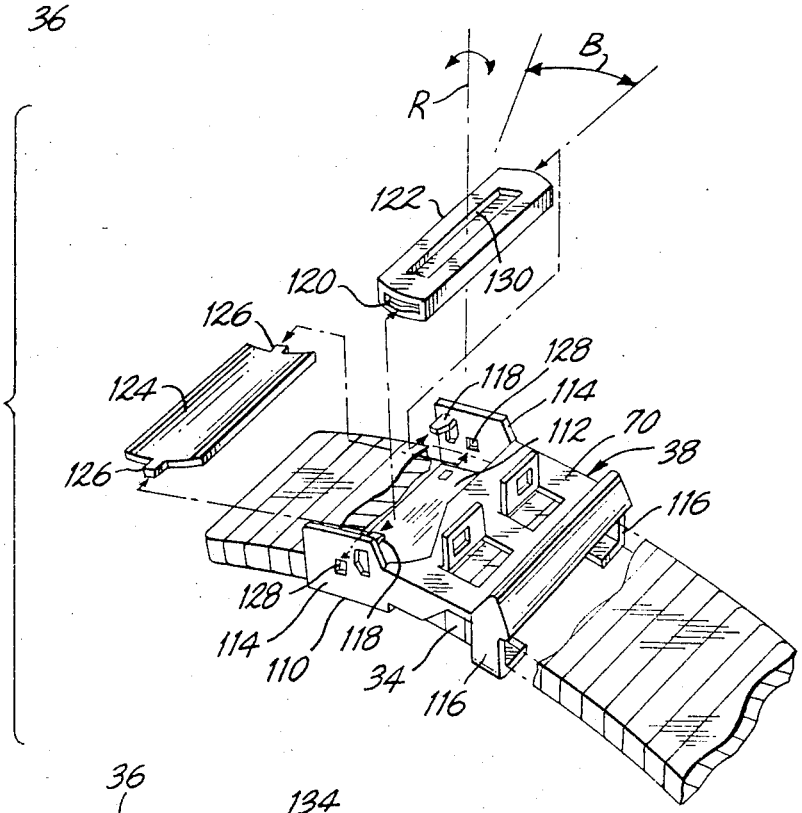
FIG. 7 is an exploded perspective view of the other clasp member of the clasp.

Thus, the second clasp member is provided with an adjustment feature. Turning now to FIG. 7, as well as to FIG. 3, base 38 extends forward to include a channel portion 110 having a bottom wall 112 and side walls 114 defining a channel through which band segment 34 extends. A pair of guides 116 depend from the base 38 at the rearward edge of platform portion 70 to assist in maintaining the base 38 in proper position upon the band segment 34. A pair of tongues 118 project inwardly toward one another from side walls 114 and enter complementary grooves 120 in the sides of a clamping member 122 to hold clamping member 122 between the side walls 114. A resilient gripping member 124 is interposed between the clamping member 122 and bottom wall 112 and is held in place by ears 126 which extend outwardly from gripping member 124 and enter complementary apertures 128 in side walls 114.

In operation, band segment 34 is slipped into the channel above bottom wall 112 and between side walls 114, beneath gripping member 124 and clamping member 122. Grooves 120 are elongate and the sides of the clamping member 122 are arcuate so that clamping member 122 may be rotated through an arc B, preferably of about 28°, about an axis R, generally normal to the bottom wall 112. Grooves 120 are inclined so that such rotation of clamping member 122 will raise or lower the clamping member relative to bottom wall 112. Gripping member 124 is constructed of a springy material and is arched so that downward movement of the clamping member 122 will compress the arch of the gripping member 124 and exert a clamping force to clamp the band segment 34 between the gripping member 124 and the bottom wall 112, the gripping member serving to compensate for any variations in the thickness of the band segment 34. A slot 130 in the clamping member 122 enables the insertion of a turning tool, such as a screw driver or even a coin, to facilitate turning the clamping member 122 into the fully clamped position against the resilience of the gripping member 124. The clamping arrangement is readily released for re-adjustment by merely turning the clamping member 122 in the opposite direction.

As best seen in FIGS. 1 and 2, clasp 30 is provided with an aesthetically pleasing, uncluttered appearance. Thus, the first clasp member includes a cover portion 132 extending rearwardly along case 36 to enclose the clamping arrangement provided by clamping member 122, when the first and second clasp members are coupled together. Both clasp members are easily constructed of a minimal number of component parts and may be fabricated of precious or semi-precious metals, as well as less expensive materials. Assembly is simple and provides a rugged clasp for dependable positive securement over a long service life. In use, the clasp is exceptionally simple to couple, requiring mere juxtaposition of the clasp members in overlapping relationship and pressing together of the clasp members to engage the latching mechanism. Disengagement also is accomplished with ease, and inadvertent disengagement is precluded.

Figure 8:
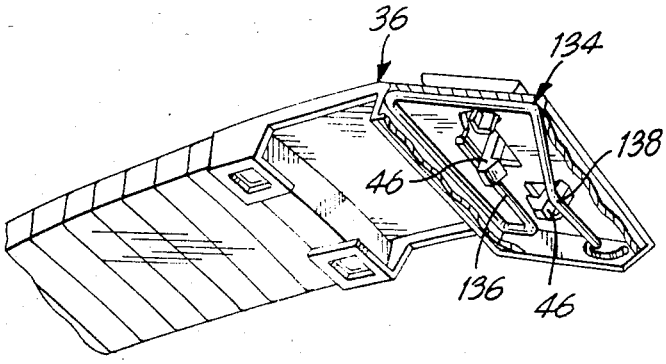
FIG. 8 is a perspective view of the one clasp member, showing an alternate locking mechanism.
Figure 9:
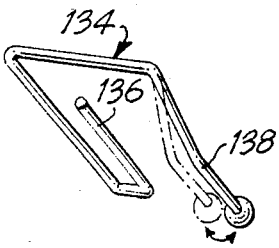
FIG. 9 is a perspective view of a component part of the alternate locking mechanism of FIG. 8.

Turning now to FIGS. 8 and 9, an alternate construction is illustrated in which the leaf spring 80 and the locking lever 40 of the above-described clasp 30 have been replaced by a single element 134. Element 134 is seated within case 36, as seen in FIG. 8, and includes a leaf spring portion 136 urged against one of the first latch members 46 to bias the first latch members 46 into the latching position. A lock bar portion 138 may be placed in the locking position, as shown in full lines in FIG. 8 and in phantom in FIG. 9, where the lock bar portion 138 is seated against a first latch member 46 to preclude rotation of carriage 48 to move the first latch members 46 out of the latching position.

Referring now to FIGS. 10 through 15, another clasp 140 constructed in accordance with the invention is shown for connecting together smaller band segments 142 and 144, such as might be found in a ladies' watch band. The construction and operation of clasp 140 is somewhat similar to the earlier described embodiments of FIGS. 1 through 9, but the construction enables a more compact arrangement of parts.

Thus, the first clasp member 146 includes a platform 148 upon which a carriage 150 is pivotally mounted by a pivot pin 152 for rotation about a pivotal axis PP. A pair of latch members 154 depend from carriage 150 and include latch bars 156 spaced altitudinally downwardly from the platform 148. Latch bars 154 extend laterally inwardly, toward one another, and overlap with lower surface 157 of platform 148 to retain the carriage 150 in place upon the platform 148, mounted for pivotal movement on pivot pin 152. A spring 158 biases the carriage 150 and the latch members 154 into latching position and a knob 160 is secured to carriage 150, by means of tabs 162, to enable manual rotation of carriage 150 to move the latch members 154 selectively out of the latching position.

Figure 14:
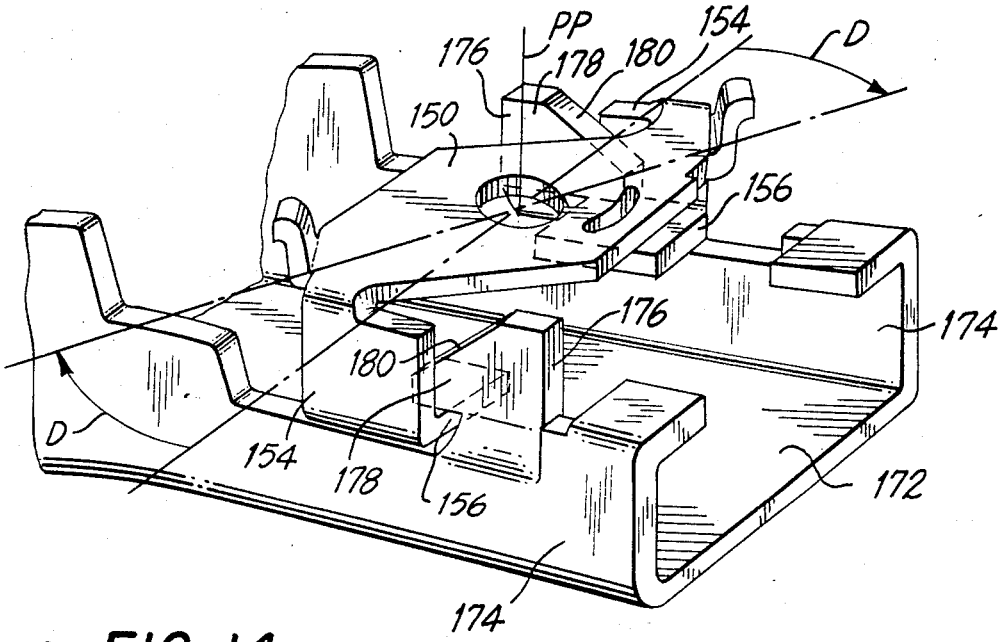
FIG. 14 is a fragmentary perspective view illustrating the latching mechanism of the clasp.
Figure 15:
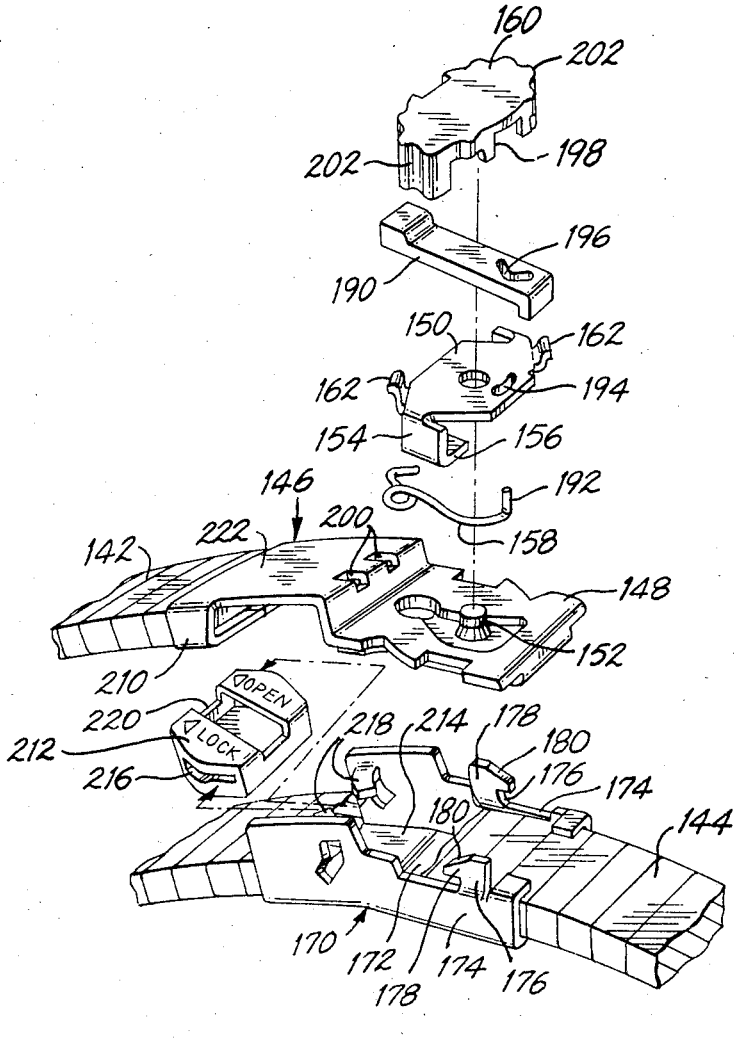
FIG. 15 is an exploded perspective view of the clasp.

The second clasp member 170 includes a platform 172 and side walls 174. A pair of latch members 176 project altitudinally upwardly from the platform 172 and provide latch teeth 178 spaced upwardly from the platform 172. Inclined surfaces 180 on the latch teeth 178 serve as camming means when engaged by the latch bars 156 upon overlapping the clasp members 146 and 170 and, upon urging the clasp members into coupled engagement, the camming means will rotate the carriage 150, against the bias of spring 158, as indicated at D in FIG. 14, to enable the latch bars 156 to pass over the latch teeth 178. Once the latch bars 156 clear the latch teeth 178, the latch bars 156 will be returned to the latching position beneath the latch teeth 178, as shown in FIG. 14, to secure the coupled clasp members 146 and 170 together.

Figure 10:
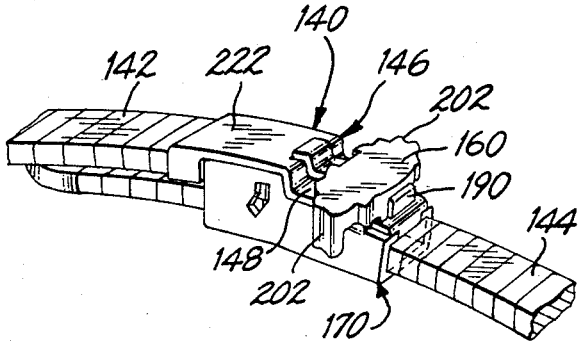
FIG. 10 is a pictorial view of another clasp constructed in accordance with the invention, coupled to secure together segments of a ladies' watch band.
Figure 11:
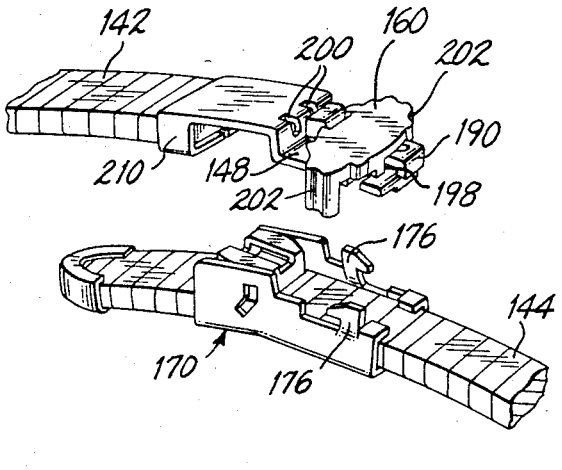
FIG. 11 is a pictorial view of the clasp, uncoupled.
Figure 12:
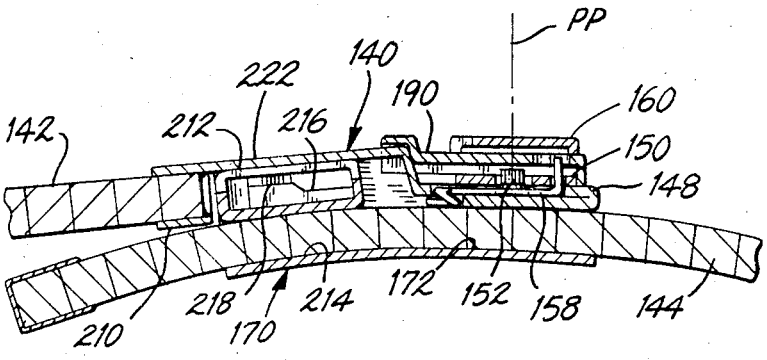
FIG. 12 is a longitudinal cross-sectional view of the clasp coupled and securing together the watch band segments.
Figure 13:
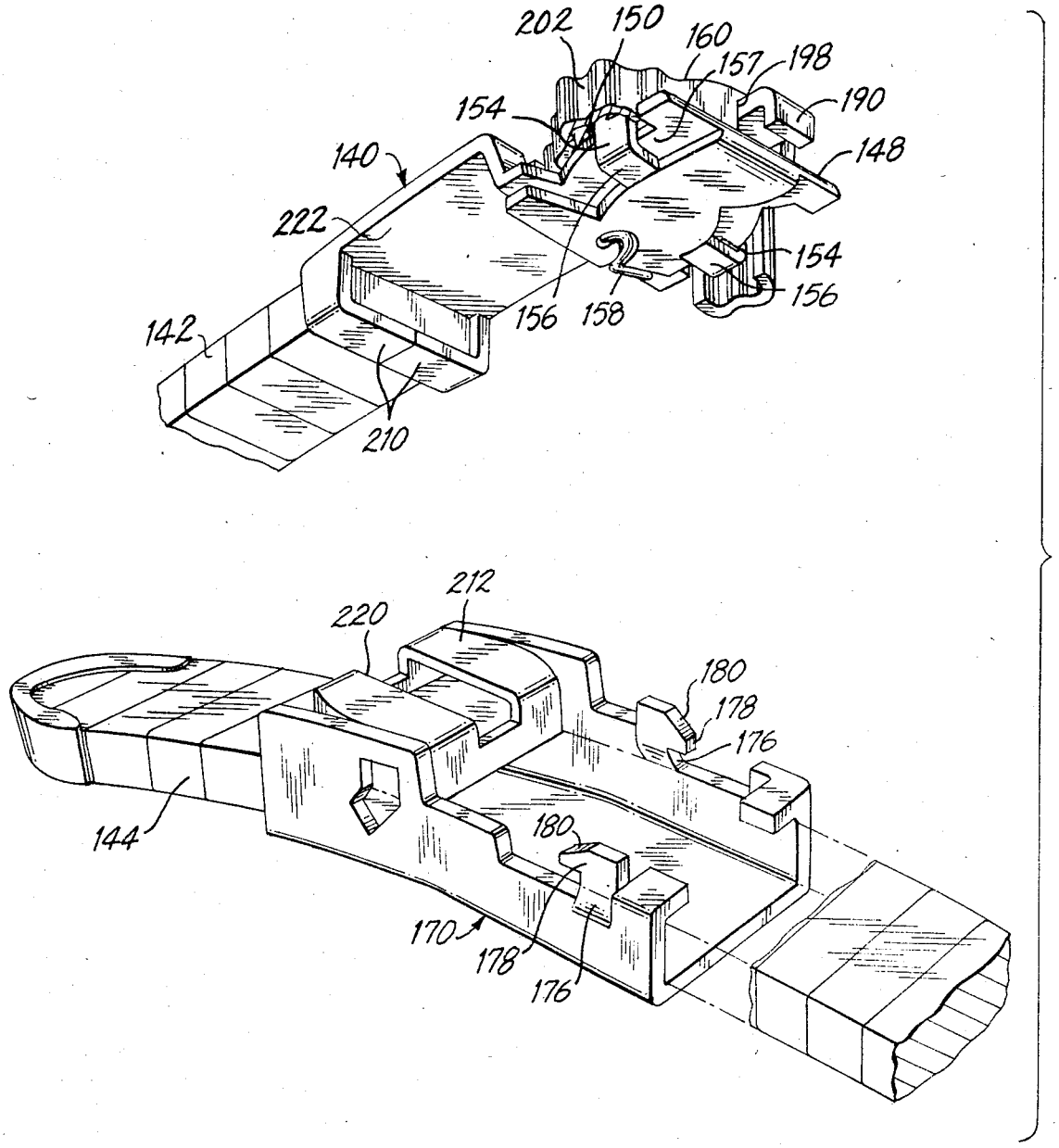
FIG. 13 is a pictorial view of the clasp, uncoupled, as viewed from another position.

In order to preclude inadvertent unlatching of the latching mechanism, a slide 190 is mounted upon the assembled carriage 150 and knob 160 for sliding movement in longitudinal directions. A portion 192 of spring 158 passes through a slot 194 in the carraige 150 and not only engages the carriage for biasing the latch members 154 into the latching position, but also enters a V-shaped slot 196 in the slide 190. Slide 190 is guided for sliding movement within a channel 198 in the knob 160 between a locked position, as seen in FIGS. 10 and 12, where the rearward end of the slide 190 engages notches 200 to preclude rotation of the knob 160 and carriage 150, and an unlocked position, as seen in FIG. 11, where the knob 160 and carriage 150 are free to rotate by manual gripping of finger grips 202 on the knob 160. The slide 190 is retained in either of the locked or unlocked positions by the portion 192 of spring 158, which serves as a detent in connection with V-shaped slot 196.

As in the earlier-described embodiments, brackets 210 are provided for attaching the first clasp member 146 to band segment 142, as by soldering. The second clasp member 170 is clamped to the band segment 144 by means of a rotatable clamping member 212 which clamps the band segment 144 against a bottom wall 214, the clamping member 212 including inclined grooves 216 which receive tongues 218 for mounting the clamping member 212 in the clasp member 146. A slot 220 facilitates rotation of the clamping member 212 and a cover portion 222 on the first clasp member 146 encloses the clamping mechanism provided by clamping member 212.

Figure 16:
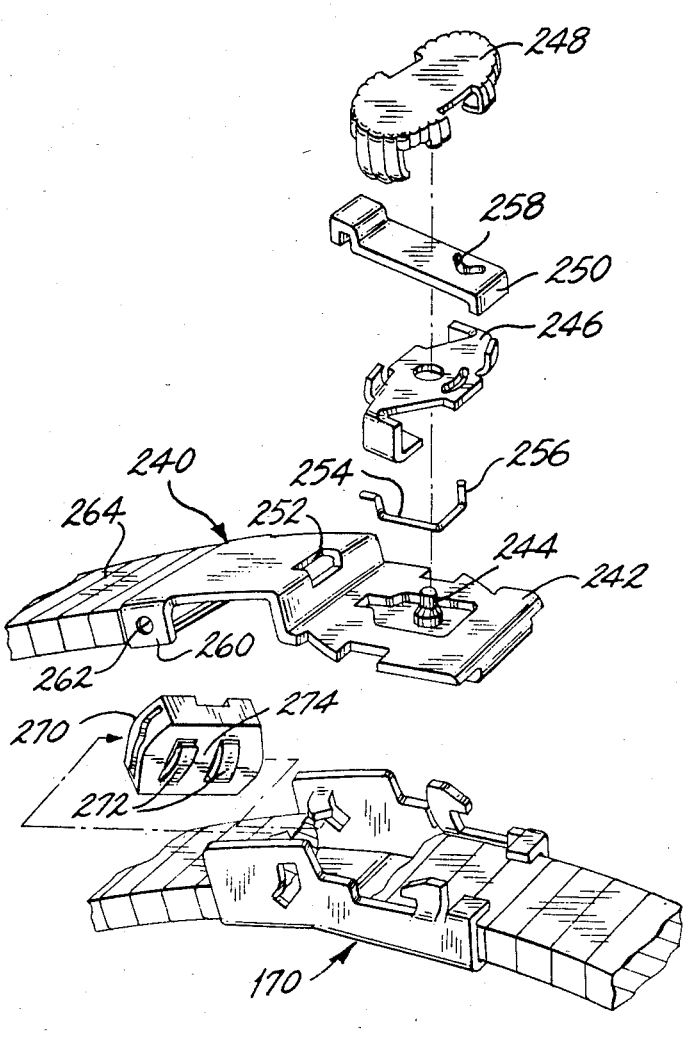
FIG. 16 is an exploded perspective view of another clasp constructed in accordance with the invention.
Figure 17:
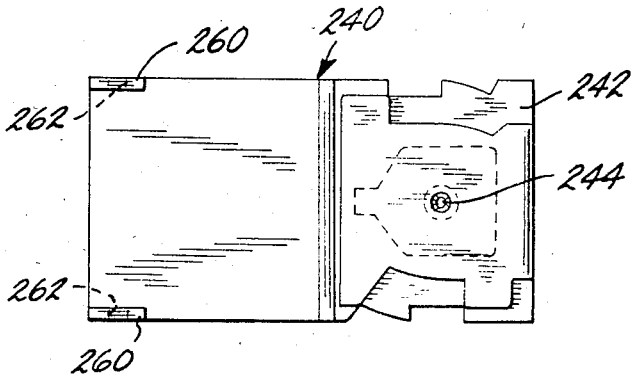
FIG. 17 is a bottom plan view of a component part of the clasp.
Figure 18:
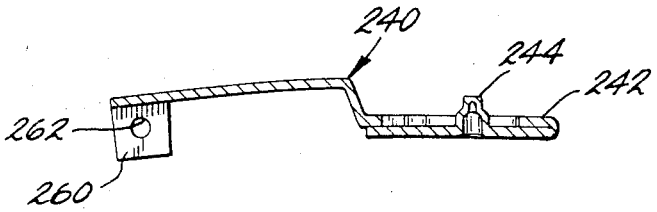
FIG. 18 is a longitudinal cross-sectional view of the component part of FIG. 17.

The embodiment of FIGS. 16 through 18 is very similar to that of FIGS. 10 through 15. Second clasp member 170 is utilized in the embodiment of FIGS. 16 through 18 with only a slight modification, as will be described below, but the first clasp member is modified in several respects. Thus, first clasp member 240 includes a platform 242 with a unitary pivot post 244 upon which a carriage 246 is pivotally mounted. As in the earlier-described embodiment, a knob 248 is assembled with the carriage 246 and a slide 250 is movable between a locked position, where the slide 250 engages a notch 252, and an unlocked position, where the knob 248 and carriage 246 are free for manual rotation. A spring 254 biases the carriage into a latching position and portion 256 of spring 254 extends upwardly to enter V-shaped slot 258 and serve as a detent. In this instance, the first clasp member 240 is provided with mounting tabs 260 having holes 262 therein, enabling the first clasp member 240 to be attached to the corresponding band segment 264 in a manner similar to a conventional buckle.

As described above, the second clasp member is essentially the same as clasp member 170. However, the clamping member 212 of clasp member 170 has been replaced with clamping member 270 which includes integral gripping members in the form of resilient pads 272 struck downwardly from the bottom 274 of the clamping member 270 to provide resilient gripping members unitary with the clamping member itself.

Turning now to FIG. 19, a clasp 300 is provided for use in connection with band segments 302 and 304 which terminate in brackets 306 having standard pin connectors 308. Both the first clasp member 310 and the second clasp member 312 are constructed similar to the clasp members of the embodiment of FIGS. 16 through 18, with the exception of the attaching means. Thus, each clasp member 310 and 312 is provided with a sleeve 314 made unitary with the platform of the clasp member so as to receive a corresponding pin connector 308.

In the embodiment of FIGS. 20 through 25, a clasp 320 is provided for use in connection with band segments 322 and 324 which require that the clasp members be attached through a soldered connection. Thus, the clasp members 326 and 328 each have a platform 330 and 332, respectively, from which there projects a tongue 334 having an aperture 336. A coupling 340 is soldered at 342 to the terminal end of each band segment 322 and 324. Each coupling 340 has a socket 344 for receiving the tongue 334 of the corresponding clasp member. Once the tongue 334 is seated within the socket 344, a tab 346 is bent upwardly so that a tooth 348 carried by the tab 346 enters the aperture 336 and captures the tongue 334 in the socket 344. In this manner, clasps 320 constructed in accordance with the invention are adapted to a wide variety of ornamental items, including delicate bracelets and necklaces, as well as heavier items such as watch bands and the like.

The clasp of the present invention provides a positive, secure connection while maintaining ease of use and simplicity of manufacture. The clasp is aesthetically pleasing, enabling widespread use in connection with a variety of ornamental items. The clasp presents smooth, uncluttered external contours, with the latching mechanism being entirely encased within the clasp for enhanced security as well as for appearance. The construction is economical yet rugged enough to withstand rigorous use throughout a long service life.

It is to be understood that the above detailed description of embodiments of the invention are provided by way of example only. Various details of design and construction may be modified without departing from the true spirit and scope of the invention, as set forth in the appended claims.

The embodiments of the invention in which an exclusive property or privilege is claimed are defined as follows:

1. A clasp for connecting together juxtaposed, longitudinally-extending first and second band segments to secure selectively an ornamental item, such as a watch band, upon a wearer, the clasp comprising:

a first clasp member;

first attaching means for attaching the first clasp member to the first band segment;

the first clasp member including a first platform portion extending in directions generally parallel to the longitudinal extent of the first band segment, and at least one pair of first latching members carried by the first platform portion and extending generally perpendicular to the first platform portion;

a second clasp member;

a second attaching means for attaching the second clasp member to the second band segment;

the second clasp member including a second platform portion extending in directions generally parallel to the longitudinal extent of the second band segment, and at least one pair of second latching members carried by the second platform portion and extending generally perpendicular to the second platform portion;

pivot means mounting at least one of said pairs of first and second latching members for rotation relative to the other of said pairs of first and second latching members upon juxtaposition of the band segments and overlapping of the first and second clasp members, such that the latching members couple together the first and second clasp members in response to overlapping the first and second clasp members; and operator means carried by one of the first and second clasp members and coupled with at least one of said pairs of first and second latching members for movement of that pair of latching members in response to selective manual movement of the operator means such that the latching members are disengaged to uncouple the overlapped first and second clasp members, so as to disconnect selectively the juxtaposed first and second band segments and release the ornamental item from the wearer.

2. The invention of claim 1 wherein the operator means is mounted for rotation about an axis of rotation generally normal to the platform portion of the clasp member upon which the operator means is carried.

3. The invention of claim 1 wherein the pivot means mounts said one pair of latching means for rotation about an axis of rotation generally normal to the platform portions of the overlapping first and second clasp members between a first position wherein the first and second latching members are engaged, and a second position wherein the first and second latching members are disengaged.

4. The invention of claim 3 wherein the operator means is mounted for rotation about said axis of rotation.

5. The invention of claim 3 including biasing means for biasing said one pair of latching members toward the first position.

6. The invention of claim 5 wherein the biasing means comprises a spring member.

7. The invention of claim 3 including a locking member mounted for selective movement into and out of a locking position in which locking position the locking member precludes pivotal movement of said one pair of latching members to said second position.

8. The invention of claim 1 wherein one of the first and second attaching means includes:

a clamping surface on the corresponding clasp member;

a clamping member mounted upon the corresponding clasp member for movement selectively toward and away from the clamping surface to admit the corresponding band segment between the clamping member and the clamping surface and secure the clasp member at a selected location along the corresponding band segment; and a cover portion on the other clasp member for covering the clamping member upon coupling the overlapped first and second clasp members.

9. The invention of claim 8 wherein the clamping member is mounted for rotation relative to the corresponding clasp member, between a first position wherein the clamping member is spaced away from the clamping surface to permit the corresponding band segment to be slipped between the clamping member and the clamping surface, and a second position wherein the clamping member is moved toward the clamping surface to clamp together the corresponding band segment and the corresponding clasp member, said one attaching means further including resilient gripping means interposed between the corresponding band segment and at least one of the clamping member and the clamping surface.

10. A clasp for connecting together juxtaposed, longitudinally-extending first and second band segments to secure selectively an ornamental item, such as a watch band, upon a wearer, the clasp comprising:

first and second clasp members, each including a platform extending in directions generally parallel to the longitudinal extent of the band segments such that the platform of one clasp member will overlap with the platform of the other clasp member when the clasp members are coupled together to connect the band segments;

a pair of first latch members carried by one platform, the first latch members being spaced apart laterally from one another and being spaced altitudinally from said one platform toward the other platform;

a pair of second latch members carried by the other platform, the second latch members being spaced apart laterally from one another and being spaced altitudinally from the other platform toward the one platform in corresponding relationship with the first latch members such that the first and second latch members will be in latching engagement between the platforms of the clasp members when the clasp members are coupled together;

pivot means mounting the first latch members on the one platform for pivotal movement relative to the second latch members, about a pivotal axis located intermediate the first latch members and extending generally normal to the one platform, said pivotal movement being between a first position wherein the first latch members are interengaged with the second latch members to secure together the overlapped platforms, and a second position wherein the first latch members are disengaged from the second latch members;

camming means associated with the first latch members for pivoting the first latch members away from the first position and toward the second position in response to movement of the platforms toward one another, and toward the overlapped relationship, along a direction generally normal to the overlapped platforms;

biasing means associated with the first latch members for biasing the first latch members into the first position to secure together the platforms upon arrival of the platforms at the overlapped relationship and couple together the clasp members; and operator means associated with the first latch members for selectively moving the first latch members toward the second position, against the bias of the biasing means, to disengage the first latch members from the second latch members and selectively uncouple the clasp members.

11. The invention of claim 10 wherein:

the first latch members include latch teeth spaced from the corresponding one platform; and the second latch members include latch bars spaced from the corresponding other platform such that the latch teeth are engaged with the latch bars between the overlapped platforms.

12. The invention of claim 11 wherein the camming means includes inclined surfaces on the latch teeth for engaging the latch bars to move the first latch members toward the second position.

13. The invention of claim 11 wherein:

the one platform includes an inner surface and an opposite outer surface, the inner surface confronting the other platform when the platforms are overlapped;

the corresponding clasp member includes a carriage carrying the first latch members and mounted upon the one platform by said pivot means, the carriage being juxtaposed with the outer surface of the one platform and the first latch members extending beyond the one platform to place the latch teeth between the inner surface and the confronting other platform; and the operator means includes finger-grip portions on the carriage.

14. The invention of claim 13 including a locking member mounted upon said corresponding clasp member for selective movement into and out of a locking position, in which locking position the locking member precludes pivotal movement of the carriage to move the first latch members out of the first position thereof.

15. The invention of claim 10 wherein:

the first latch members include latch bars spaced from the corresponding one platform; and the second latch members include latch teeth spaced from the corresponding other platform such that the latch bars are engaged with the latch teeth between the overlapped platforms.

16. The invention of claim 15 wherein the camming means includes inclined surfaces on the latch teeth for engaging the latch bars to move the first latch members toward the second position.

17. The invention of claim 16 wherein:

the one platform includes an inner surface and an opposite outer surface, the inner surface confronting the other platform when the platforms are overlapped;

the corresponding clasp member includes a carriage carrying the first latch members and mounted upon the one platform by said pivot means, the carriage being juxtaposed with the outer surface of the one platform and the first latch members extending beyond the one platform to place the latch bars between the inner surface and the confronting other platform; and the operator means includes finger-grip portions on the carriage.

18. The invention of claim 17 including a locking member mounted upon said corresponding clasp member for selective movement into and out of a locking position, in which locking position the locking member precludes pivotal movement of the carriage to move the first latch members out of the first position thereof.

19. The invention of claim 10 including first attaching means on the first clasp member and second attaching means on the second clasp member and wherein one of the first and second attaching means includes:

a clamping surface on the corresponding clasp member;

a clamping member mounted upon the corresponding clasp member for movement selectively toward and away from the clamping surface to admit the corresponding band segment between the clamping member and the clamping surface and secure the clasp member at a selected location along the corresponding band segment; and a cover portion on the other clasp member for covering the clamping member upon coupling the overlapped first and second clasp members.

20. The invention of claim 19 wherein the clamping member is mounted for rotation relative to the corresponding clasp member, between a first position wherein the clamping member is spaced away from the clamping surface to permit the corresponding band segment to be slipped between the clamping member and the clamping surface, and a second position wherein the clamping member is moved toward the clamping surface to clamp together the corresponding band segment and the corresponding clasp member, said one attaching means further including resilient gripping means interposed between the corresponding band segment and at least one of the clamping member and the clamping surface.

* * * * *